United States Patent [19]

Tschantz

[11] Patent Number: 4,592,516

[45] Date of Patent: Jun. 3, 1986

[54] COAL BREAKER AND SORTER

[75] Inventor: William H. Tschantz, Canton, Ohio

[73] Assignee: Quadracast, Inc., Canton, Ohio

[21] Appl. No.: 587,550

[22] Filed: Mar. 8, 1984

Related U.S. Application Data

[63] Continuation-in-part of Ser. No. 520,061, Aug. 3, 1983, abandoned.

[51] Int. Cl.[4] ..... B02C 13/04; B02C 13/09

[52] U.S. Cl. ..... 241/76; 241/77; 241/78; 241/79; 241/154; 241/187; 241/189 R; 241/275

[58] Field of Search ..... 241/40, 76, 77, 78, 241/79, 81, 96, 152 R, 152 A, 154, 157, 187, 193, 194, 275, 189 R

[56] References Cited

U.S. PATENT DOCUMENTS

| | | |
|---|---|---|
| 1,824,681 | 9/1931 | O'Neil . |
| 2,110,850 | 3/1938 | Symons . |
| 2,192,606 | 3/1940 | Symons . |
| 2,357,843 | 9/1944 | Morrissey . |
| 2,644,644 | 7/1953 | West . |
| 2,798,674 | 7/1957 | Denning . |
| 3,344,999 | 10/1967 | Kessler . |
| 3,934,826 | 1/1976 | Graveman . |

*Primary Examiner*—Howard N. Goldberg
*Assistant Examiner*—Timothy V. Eley
*Attorney, Agent, or Firm*—Sand & Hudak Co.

[57] ABSTRACT

A device for breaking coal and for separating predetermined size coal particles and impurities therefrom. A supply of coal containing rock, shale and other impurities is dumped in a hopper through a top opening. A zigzag-shaped passageway extends from the top to the bottom of the hopper and has a single double action accelerator rotor or a pair of accelerator rotors mounted therein. The rotors increase the speed of the deposited materials that are moving by gravity through the passageway by striking the material and propelling it in the same direction that it was moving prior to being struck. The coal is split upon impact against splitting grates. Chutes located beneath the splitting grates receive the coal particles which pass through sized openings formed in the grates and deposit it in a collection area. The rotors each include a shaft with a plurality of radially outwardly extending blades. The materials move along inclined feed grates which extend downwardly inwardly in the passageway and which are tangent to the periphery of the rotating rotor blades which enable the coal to be accelerated without a change in direction. Oversized coal particles and impurities will drop onto a vibrating grate at the bottom of the hopper which provides a final separation for the correctly sized coal particles before discharging the remaining impurities onto a refuse pile.

30 Claims, 18 Drawing Figures

COAL BREAKER AND SORTER

CROSS-REFERENCE

This application is a continuation-in-part of pending application Ser. No. 520,061 filed Aug. 3, 1983 now abandoned.

TECHNICAL FIELD

The invention relates to equipment in the coal processing industry and in particular to a device which breaks and sorts coal into a predetermined desired size and separates many impurities therefrom, after the coal has been removed from a mine or strip pit. More particularly the invention relates to such a device in which the coal is broken into smaller particles by accelerating the coal and impelling it against breaker bars within a hopper.

BACKGROUND ART

It is necessary upon removing coal from a mine or strip pit to further process the coal before use by breaking the coal and sorting it into certain sizes and removing rocks, shale or other impurities therefrom. Depending upon the final use for which the coal is intended and the type and hardness of the particular coal being mined, the coal is broken and separated into predetermined size particles. Two inch size particles is a common size for many burning applications.

This crushing and splitting of the coal has been performed by various types of equipment such as a rotary roll crusher in which coal passes between and is crushed by counter-rotating rolls and then discharged into a chute or conveyor for subsequent shipment. Such roll crushers have the disadvantage in that everything including coal and other impurities must go through the crusher rolls and are broken into smaller particles. It is preferable that impurities be removed and not crushed and transported with the coal. Another type of prior art crusher or breaker is a rotary breaker which consists of a large hollow rotating drum having a plurality of holes and baffles inside which will break the coal as it is tumbled wirhin the drum.

Although these breakers perform satisfactorily, they require a considerable amount of energy for rotating the drum or crusher rolls. Furthermore, it is difficult to change the setting for the size coal desired. Also it is difficult to conform the breaking force with the hardness of the particular seam of coal being broken by the equipment.

These known crushers usually are located at a coal wash plant which may be located some distance from the mine or pit, requiring the coal together with the impurities to be transported to the processing site with the refuse or removed impurities being returned to the original site for disposal. All of these hauling and processing operations increase the cost of processing the coal.

Several types of coal breakers use rotors which propel the coal against impact surfaces for breaking the coal into smaller particles. Examples of these types of breakers are shown in U.S. Pat. Nos. 2,119,850 and 2,192,606. Although these breakers perform satisfactorily, they require a relatively large motor and increased power because of the heavy structural members since the rotor changes the direction of the coal or material being broken after being struck with the rotor blades. Also the rotor blades perform some of the crushing or breaking action instead of merely propelling the coal particles and increasing the speed thereof for impact crushing against a surface. These types of rotary crushers also have the disadvantage of not removing the coal particles as soon as possible after being reduced to the desired size. The coal and sized particles will remain in the crusher for a longer period of time than necessary resulting in the particles being further reduced in size which results in fines or dust being created which may be too small for use and sale.

Accordingly, there is a need for an improved coal breaker and sorter which eliminates the above problems and satisfies needs existing in the art.

DISCLOSURE OF THE INVENTION

Objectives of the invention include providing an improved coal breaker and sorter construction which requires less energy for breaking and sorting coal than heretofore required for similar amounts of coal thereby reducing the cost for operating the equipment in addition to reducing the initial investment cost of the motors and control equipment.

Another objective is to provide such a device which has a plurality of power-driven rotors or accelerators which increase the speed of the coal and impurities contained therein which are moving by gravity through a passageway in a hopper, by striking the material and moving it in the same direction as it was moving prior to being struck by the accelerator rotors.

Another objective of the invention is to provide such a coal breaker and sorter construction in which the coal upon being reduced to the desired size is removed as soon as possible from within the hopper, thereby eliminating it from being further split and reduced to undesirable fines as in prior crusher constructions. A further objective is to provide such an improved coal breaker and sorter construction having greater mobility than prior crushers due to its reduced size and weight enabling it to be taken directly into a coal pit or adjacent a mine where impurities contained in the coal such as sulphur balls, rocks, slate, etc. can be removed from the mined coal eliminating hauling of such impurities to a distant plant for further processing; and in which the rotor drive motors can be either hydraulic or electric depending upon the availability of electric power at the mine or pit site.

A further objective of the invention is to provide such a construction in which the motors for driving the accelerator rotors are variable speed whereby the rotor speed can be adjusted depending upon the hardness of the coal seam which is being split and sorted at a particular time, thereby enabling accurate control of the crushing and sorting effect of the improved device by a convenient adjustment of controls located on an electrical or hydraulic control panel. Another objective is to provide such a construction in which a single double action rotor is mounted within the hopper and is located generally between two inclined surfaces for accelerating and propelling the coal as it moves along the first inclined surface against a first slotted impact surface for fracturing the coal, with the fractured coal then proceeding by gravity along the second inclined surface where it is accelerated and propelled again by the accelerator rotor against a second slotted impact surface which breaks the previously fractured coal into a reduced size, with the sized coal passing through openings in the impact surface for subsequent removal from the hopper to a collection area.

A further objective is to provide such a construction in which the slotted impact surfaces are mounted adjacent hinged panels which form part of the hopper wall enabling the impact surfaces to be easily reversed and turned upside down within the hopper to provide four usable impact surfaces to extend the life of each surface. A further objective is to provide such a construction in which only a single motor is required to operate the single double action rotor, and in which a plurality of the single double action rotors can be mounted in a vertically spaced relationship in an elongated hopper, which elongated hopper is formed by cascading or stacking a plurality of the individual rotor hopper configurations one on top of the other, to provide further breaking and sorting of the previously broken coal particles should smaller sized coal particles be desired.

Still another objective of the invention is to provide such a coal breaker and sorter which is relatively less complicated in construction and operation than prior breakers, which is less expensive to manufacture and operate, which is rugged and durable in use, which is safe in operation, and which eliminates difficulties existing in the art and solves existing problems, satisfies needs and obtains new results in the art.

These objectives and advantages are obtained by the coal breaker and sorter construction of the invention, the general nature of which may be stated as including a hopper having a passageway formed therein extending generally from an upper end to a lower end of the hopper, said hopper also being formed with an upper opening for depositing a supply of coal into the upper end of the passageway; first surface means extending downwardly inwardly in the passageway for receiving the coal deposited through the upper opening and for directing the coal as it moves by gravity along the passageway; accelerator means mounted on the hopper and located within the passageway adjacent the first surface means for increasing the speed of the coal moving along the first surface means by striking the coal and propelling it in the same direction as the slope of said first surface means; breaker means located in the passageway in the line of travel of the accelerated coal for breaking the coal upon impact when the coal strikes said breaker means; and separator means mounted beneath the breaker means for separating particles of coal of a predetermined size from other particles contained in the supply of coal deposited in the hopper.

BRIEF DESCRIPTION OF THE DRAWINGS

A preferred embodiment of the invention, illustrative of the best mode in which applicant has contemplated applying the principles, is set forth in the following description and shown in the drawings and is particularly and distinctly pointed out and set forth in the appended claims.

Similar numerals refer to similar parts throughout the drawings.

BEST MODE FOR CARRYING OUT THE INVENTION

Figure 2:
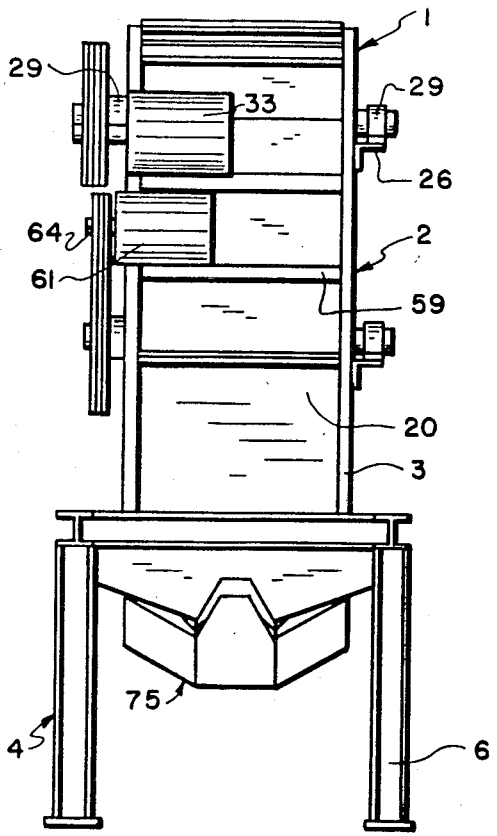
FIG. 2 is a right-hand end elevational view of the coal breaker and sorter construction of FIG. 1.
Figure 1:
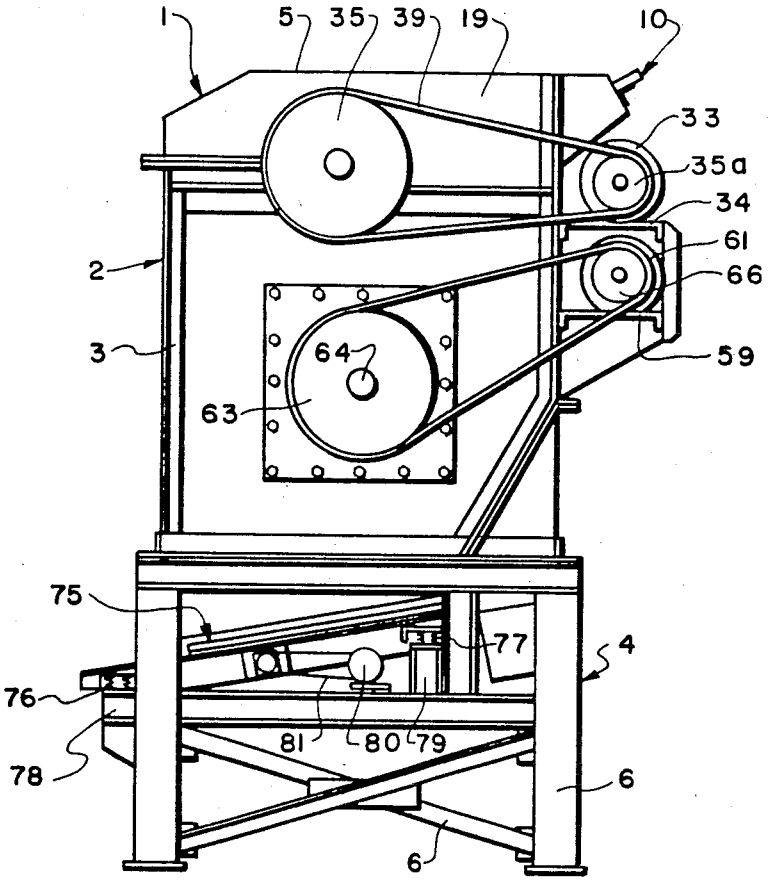
FIG. 1 is a side elevational view of the improved coal breaker and sorter construction.

The improved coal breaker and sorter construction is indicated generally at 1, and is shown in assembled elevational views in FIGS. 1 and 2. Breaker and sorter 1 includes an upper hopper indicated generally at 2, formed of a plurality of frame channels 3 with sheet metal side walls and a top sheet metal wall 5. Hopper 2 is supported on a bottom frame 4 formed of spaced vertical and diagonal beams 6 and has a zigzag formed passageway 7 (FIG. 3) therein, which extends from adjacent the top to the bottom of the hopper. A top opening 8 is formed in top wall 5 and communicates with passageway 7 through which a supply of coal which usually will contain impurities such as sulphur balls, shale, rock, etc., is deposited preferably by a conveyor or other material transfer means.

Figure 11:
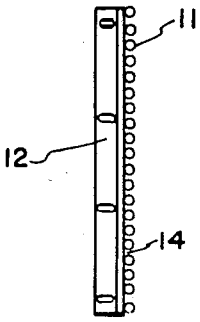
FIG. 11 is a left-hand end elevational view of the feed grate of FIG. 10.
Figure 10:
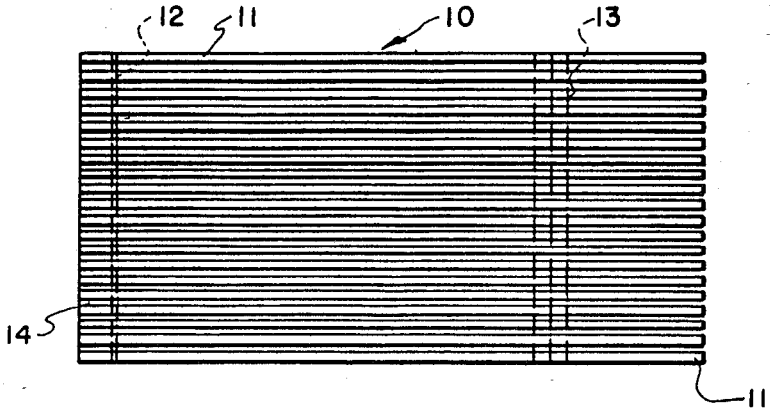
FIG. 10 is a reduced plan view of the inclined upper feed grate as shown in FIG. 3 removed from within the hopper.
Figure 12:
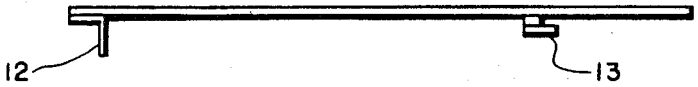
FIG. 12 is a side elevational view of the feed grate of FIG. 10.

A first inclined feed grate indicated generally at 10 (FIG. 3), is mounted within the upper portion of L passage 7 beneath top inlet opening 8 and extends downwardly inwardly into passageway 7 at an angle of approximately 35° with respect to a horizontal plane. Feed grate 10 is formed of a plurality of longitudinally extending, spaced parallel bars 11 connected by a pair of cross members 12 and 13 (FIGS. 10, 11 and 12). The spaces between bars 11 define a plurality of predetermine size openings 14. Openings 14 enable the desired size of coal to pass through the grate and fall into a chute 15 located beneath the upper portion of grate 10. Chute 15 is formed by an inclined sheet metal plate 16 which extends between and is mounted on sidewalls 18 and 19 of hopper 2 and which is connected to cross member 13 of feed grate 10. Rear hopper wall 20 forms the other wall of chute 15. The angled chute plate 16 terminates in a lower vertical wall portion 22 forming a bottom discharge opening 23. Feed grate 10 and chute 15 enable coal particles of the desired size to fall directly through grate openings 14 and be directed by chute 15 onto a conveyor 25 without passing through the crushing mechanism described in detail below. This eliminates further breaking of the correctly sized coal particles to an excessively small and unusable size as heretofore occurs in prior art crushers and sorters.

Figure 5:
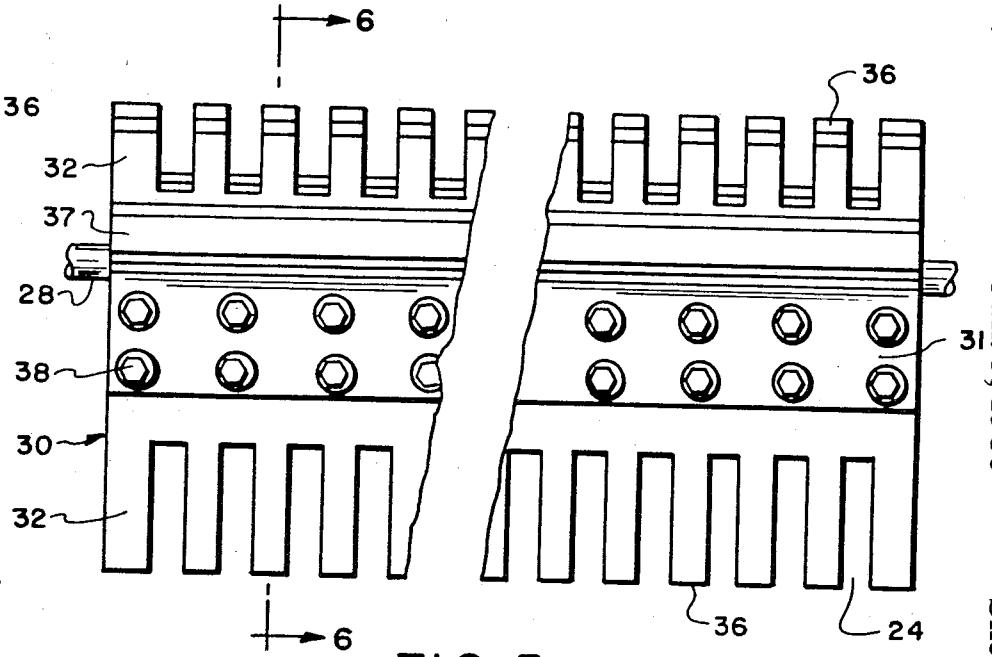
FIG. 5 is an enlarged fragmentary plan view of one of the accelerator rotors looking in the direction of arrows 5—5, FIG. 3.
Figure 6:
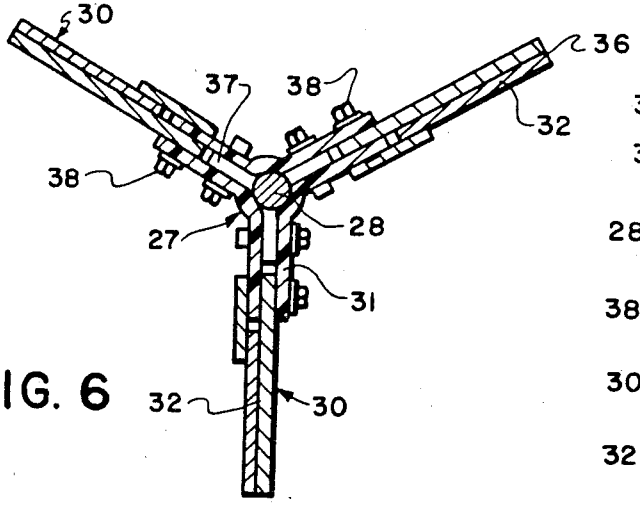
FIG. 6. is a sectional view taken on line 6—6, FIG. 5.

In accordance with one of the features of the invention, a first accelerator rotor indicated generally at 27, is mounted within passageway 7 adjacent the lower end of inclined feed grate 10. Rotor 27, is shown particularly in FIGS. 5 and 6 and includes a shaft 28 which extends horizontally between hopper sidewalls 18 and 19 and is rotatably mounted by bushing blocks 29 mounted on angled channels 26 attached to the outside surface of sidewalls 18 and 19. A plurality of equally spaced blades 30, preferably three in number as shown in the drawings, are mounted on shaft 28 and extend radially outwardly therefrom. Blades 30 include a plurality of spaced rigid metal plate pairs 32 which are resiliently mounted between a pair of elastomer mounting members 31 which are secured to rigid metal plates 37 which are welded to shafts 28 by bolts 38. Metal plate pairs 32 are formed with a plurality of spaced slots 24 which extend throughout the length of each blade 30.

Rotor 27 is power driven by an electric motor 33 that is mounted on a bracket 34 attached to rear hopper wall 20. Motor 33 is drivingly connected to rotor shaft 28 by a sheave 35 which is mounted on one end of rotor shaft 28 outside of hopper sidewall 19, by a drive belt 39 engaged with a smaller sheave **35*a*** mounted on the motor shaft.

Figure 3:
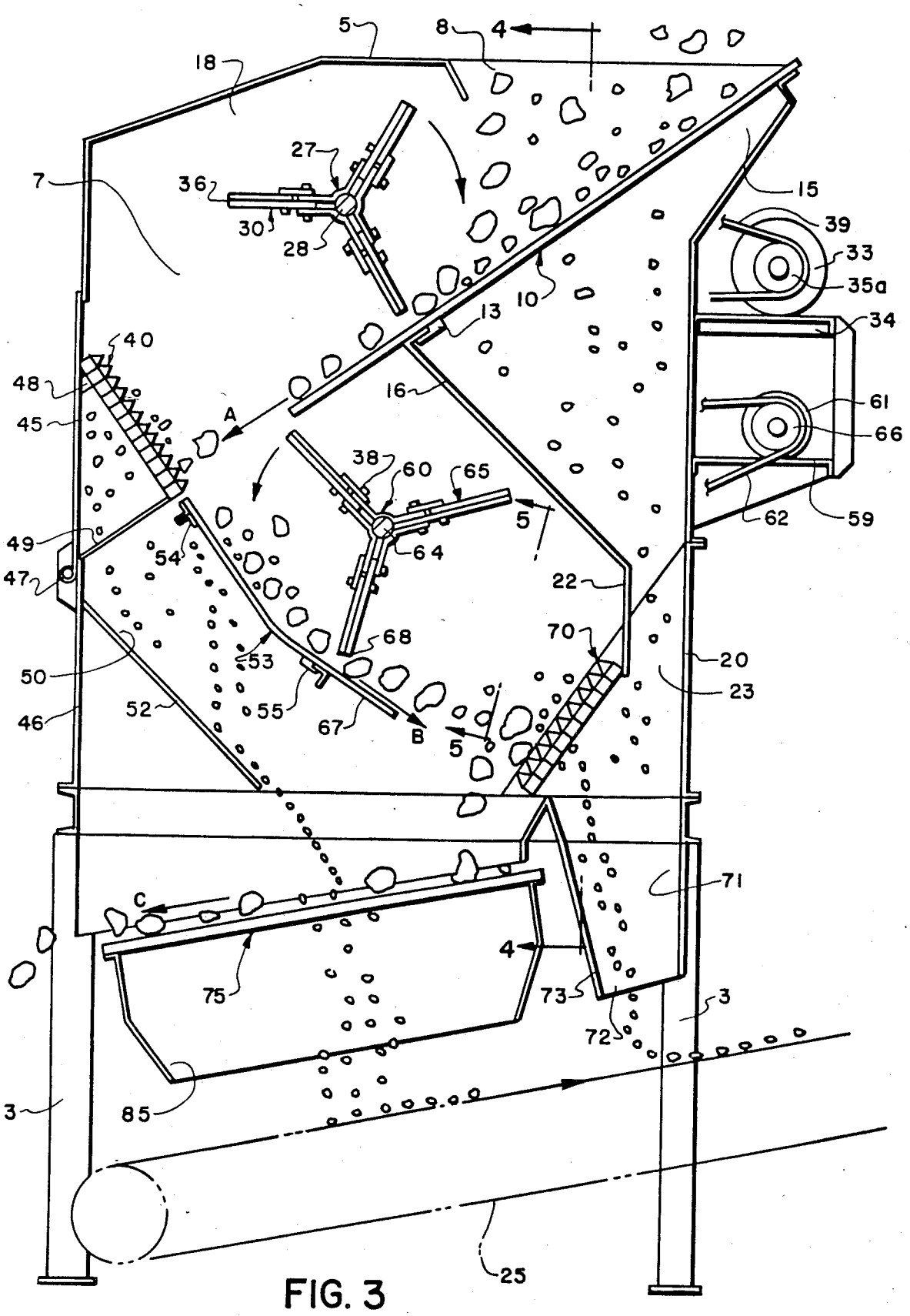
FIG. 3 is an enlarged side elevational view similar to FIG. 1 with the side wall of the hopper and lower vibrating grate removed, and with the accelerator rotor shafts shown in section.
Figure 4:
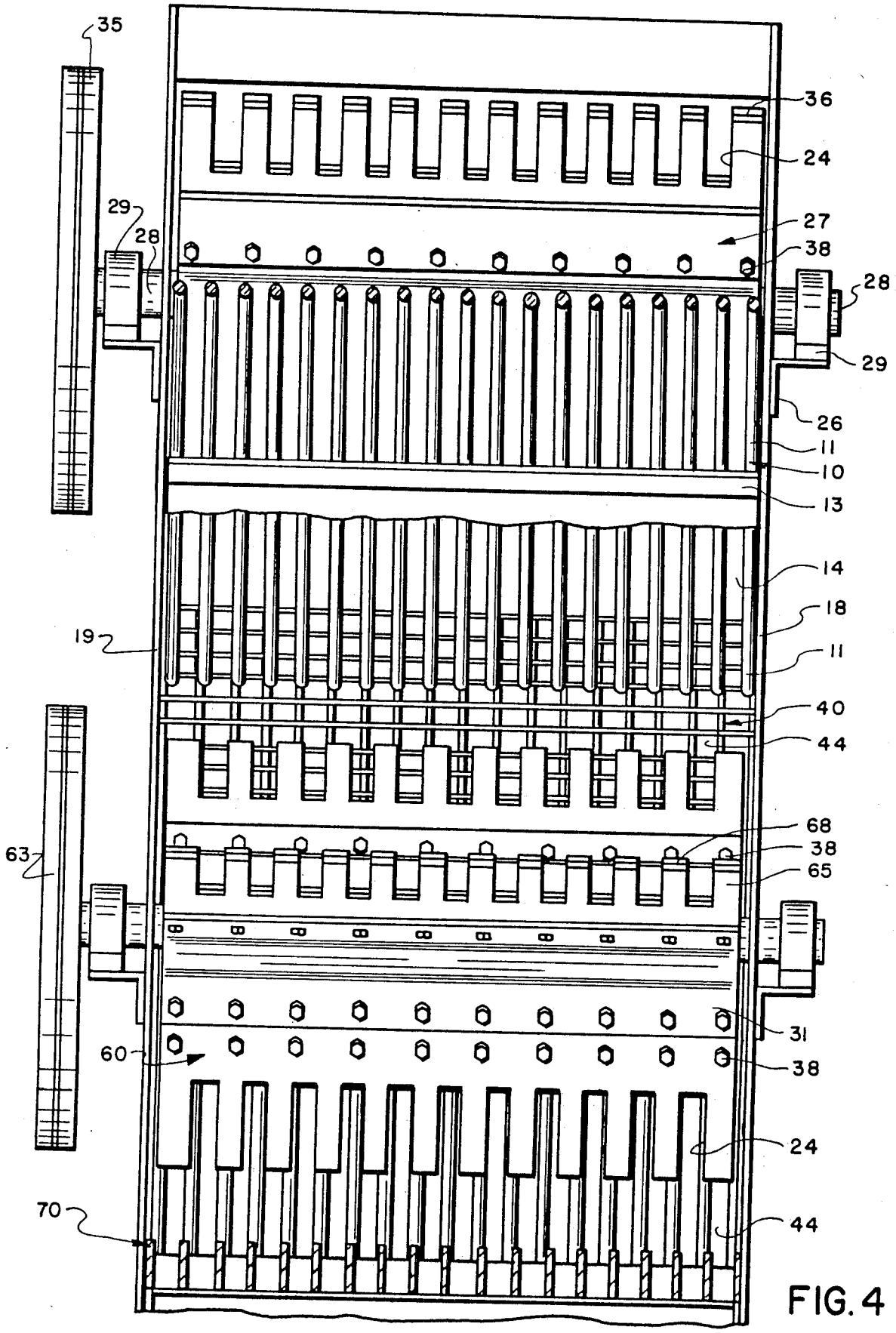
FIG. 4 is an enlarged fragmentary sectional view taken on line 4—4, FIG. 3, with portions broken away.
Figure 8:
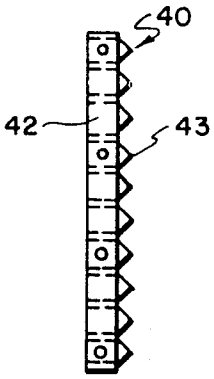
FIG. 8 is a left-hand end view of the splitting grate of FIG. 7.
Figure 7:
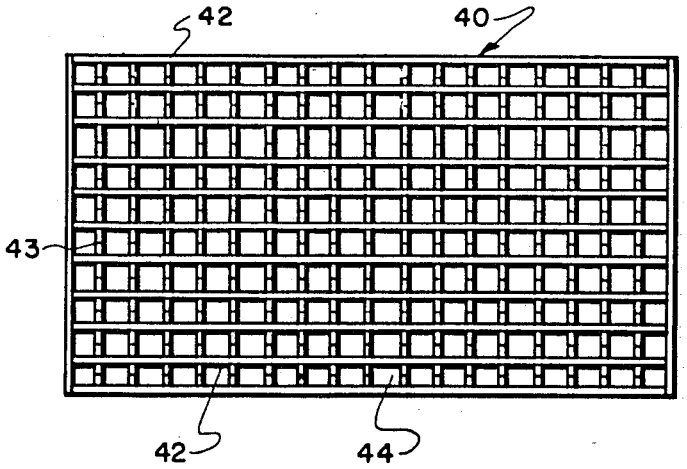
FIG. 7 is an enlarged plan view of one of the two splitting grates removed from within the hopper as shown in FIG. 3.
Figure 9:
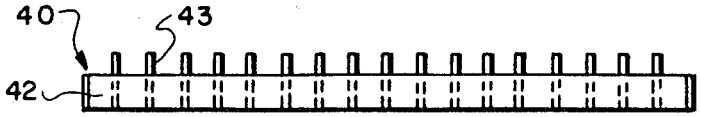
FIG. 9 is a side elevational view of the splitting grate of FIG. 7.

In accordance with one of the main features of the invention, inclined feed grate 10 is arranged so as to be generally tangent to the circular periphery defined by rotating accelerator blades 30 as shown in FIG. 3. The tips 36 of blades 30 will pass just above feed grate 10. This arrangement enables the coal particles and any impurities which roll along grate 10 to be struck by blades 30 and propelled in the same direction that they were traveling as shown by arrow A in FIG. 3, and impacted against a splitter grate, indicated generally at 40. Splitter grate 40, as shown in FIGS. 7, 8 and 9, is formed by a plurality of longitudinally extending, spaced parallel bars 42 and a plurality of pointed insert plates 43 which define openings 44. Openings 44 are similar in size to openings 14 of slotted grate 10 which corresponds to the desired coal particles to be obtained from breaker and sorter 1. Pointed insert plates 43 assist in breaking and splitting the larger coal particles as the coal is impacted against splitting grate 40. Splitting grate 40 is mounted on an outwardly swinging wall portion 45 of front hopper wall 46 which is pivotally mounted at 47 by brackets 48 and 49, and extend across passageway 7 between hopper sidewalls 18 and 19.

The split coal particles of the desired size will pass through grate openings 44 and into the upper end of a second chute indicated generally at 50. Chute 50 is formed by front hopper wall 46 and an inclined plate 52 which extends between hopper sidewalls 18 and 19.

Figure 15:
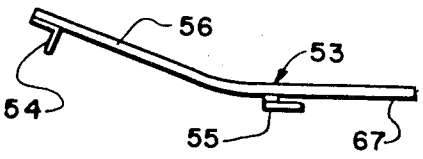
FIG. 15 is a side elevational view of the feed grate of FIG. 13.
Figure 14:
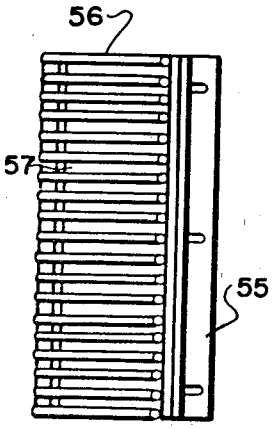
FIG. 14 is a right-hand end elevational view of the feed grate of FIG. 13.
Figure 13:
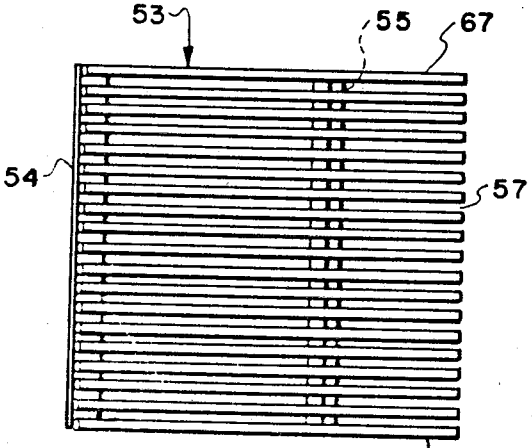
FIG. 13 is a plan view of the inclined lower feed grate as shown in FIG. 3 removed from within the hopper.

A second inclined feed grate 53 is mounted by brackets 54 and 55 in line with and below splitting grate 40 and extends between sidewalls 18 and 19. Grate 53 (FIGS. 13–15) is formed by a plurality of longitudinally extending spaced parallel bars 56 which are attached to brackets 54 and 55, and which define openings 57 similar in size to openings 14 and 44. The correct size coal particles not passing through opening 44 of splitting grate 40 will roll along feed grate 53 with the larger size particles and can drop through openings 57 and into chute 50 extending beneath grate 53.

A second accelerator rotor indicated generally at 60, is mounted in passageway 7 beneath first rotor 27. Rotor 60 is power driven by an electric motor 61 which is connected to a sheave 63 mounted on the end of rotor shaft 64 by a drive belt 62 and motor sheave 66. Motor 61 is mounted on a support bracket 59 mounted on the outside of hopper rear wall 20 in a similar manner as motor 33. A plurality of blades 65 are mounted rotor shaft 64 and extend radially outwardly therefrom in the same manner as blades 30 of accelerator rotor 27. The construction of rotor blades 65 and mounting thereof on shaft 64 is similar to that described above for blades 30 of rotor 27 and therefore is not described in further detail.

In accordance with another feature of the invention, the lower portion 67 of inclined feed grate 53 extends tangentially with respect to the imaginary circle defined by blade tips 68 of rotor blades 65 in a similar manner as do blade tips 36 correspond with inclined feed grate 10. This arrangement again enables the coal particles which move along grate portion 67 to be propelled and accelerated in their same direction of travel by rotor 60 as shown by arrow B, FIG. 3 and impacted against a second splitting grate 70. Second splitting grate 70 is similar to first splitting grate 40 and therefore is not described in detail.

A third collection chute 71 is mounted downstream and beneath second splitting grate 70 so that the correctly sized coal particles which pass through openings 44 of grate 70 are diverted by chute 71 and discharged through an open end 72 thereof, and onto conveyor 25. Discharge opening 23 of first chute 15 communicates with third chute 71 for channeling all of the sized coal particles from chute 15 onto conveyor 25 (FIG. 3). Chute 71 is formed by rear hopper wall 20 and a downwardly extending chute forming plate 73, which extends between hopper sidewalls 18 and 19.

All of the remaining coal particles and impurities which are not collected through first and third chutes 15 and 71 and deposited on conveyor 25, fall upon a vibrating grate indicated generally at 75. Grate 75 includes a plurality of intersecting bars which form openings of the desired size similar to that of openings 14 and 57 of inclined feeder grates 10 and 70, and to openings 44 of splitter grates 40 and 70. Vibrating grate 75 (FIG. 1) is of a usual construction and is mounted by springs 76 and 77 on frame channels 78 and 79, respectively, and is vibrated by a motor 80 which is connected by a drive belt 81 to an eccentric 82. Vibrating grate 75 may take various forms and may be modified without affecting the concept of the invention.

All of the desired size particles passing through the openings of vibrating grate 75 will drop through a fourth chute 85 (FIG. 3) and onto the lower end of conveyor 25 for movement to a collection area. Most of the impurities contained in the supply of coal deposited in hopper 2 will not be broken due to their greater hardness than that of the coal and will be larger than the desired size of coal particles and therefore will not pass through the various grate openings. These particles will move downwardly along vibrating grate 75 in the direction of arrow C, FIG. 3 and are deposited in a refuse area for subsequent disposal.

The operation of improved coal breaker and sorter 1 is best understood by reference to FIG. 3. A supply of coal is deposited by a conveyor (not shown) through top hopper wall opening 8 where it falls upon inclined feed grate 10. Any coal particles of the desired size will pass through grate openings 14, through chute 15 and then through chute 71 and onto conveyor 25 without further movement through passageway 7. This prevents these correctly sized coal particles from being further reduced in size. The remaining larger coal particles and any impurities present will roll along inclined grate 10 where they are accelerated by blades 30 of accelerator rotor 27 in the same direction (arrow A) as they were moving on slotted grate 10 when struck by blades 30. This propulsion in the same direction is one of the critical features of the invention since it requires considerably less power for operating rotors 27 and 60 than in prior constructions wherein the coal particles are struck by a rotor which changes the particle direction of travel.

The accelerated coal particles then contact first splitting grate 40 with the split coal particles of the desired size or smaller passing through grate openings 44 and into second chute 50 from which they fall on inclined vibrating grate 75. These sized particles will pass through the openings of vibrating grate 75 and onto conveyor 25. These particles also are eliminated from being contacted and accelerated by second accelerator rotor 60 to prevent further reduction in size by the second splitting grate 70.

The remaining coal particles and impurities will roll down along second inclined feed grate 53 where certain of the sized coal particles will pass through the openings 57 and into the lower portion of chute 50. The remaining larger coal particles and impurities then are impelled by second accelerator rotor 60 in the same manner as the particles on feed grate 10 by first accelerator rotor 27, that is in the same direction that they were traveling before being struck and without changing their subsequent direction of travel. Most of the remaining large coal particles are broken by second splitting grate 70 and the reduced coal particles will pass through the openings 44 thereof and into chute 71 and onto conveyor 25. Nearly all of the large coal particles will be broken after contacting second breaker 70 and any remaining particles will be deposited onto vibrating grate 75 which break the remaining particles and ensure that all of the sized coal particles are deposited on conveyor 25.

The impurities generally will not be broken by breakers 40 and 70 since the speed of impact can be regulated by the rotational speed of rotor motors 33 and 61. These impurities and any large unbroken particles of coal will move along vibrating grate 75 in the direction of arrow C and will be collected in a refuse pile and/or conveyor (not shown) for removal to a disposal site.

Figure 16:
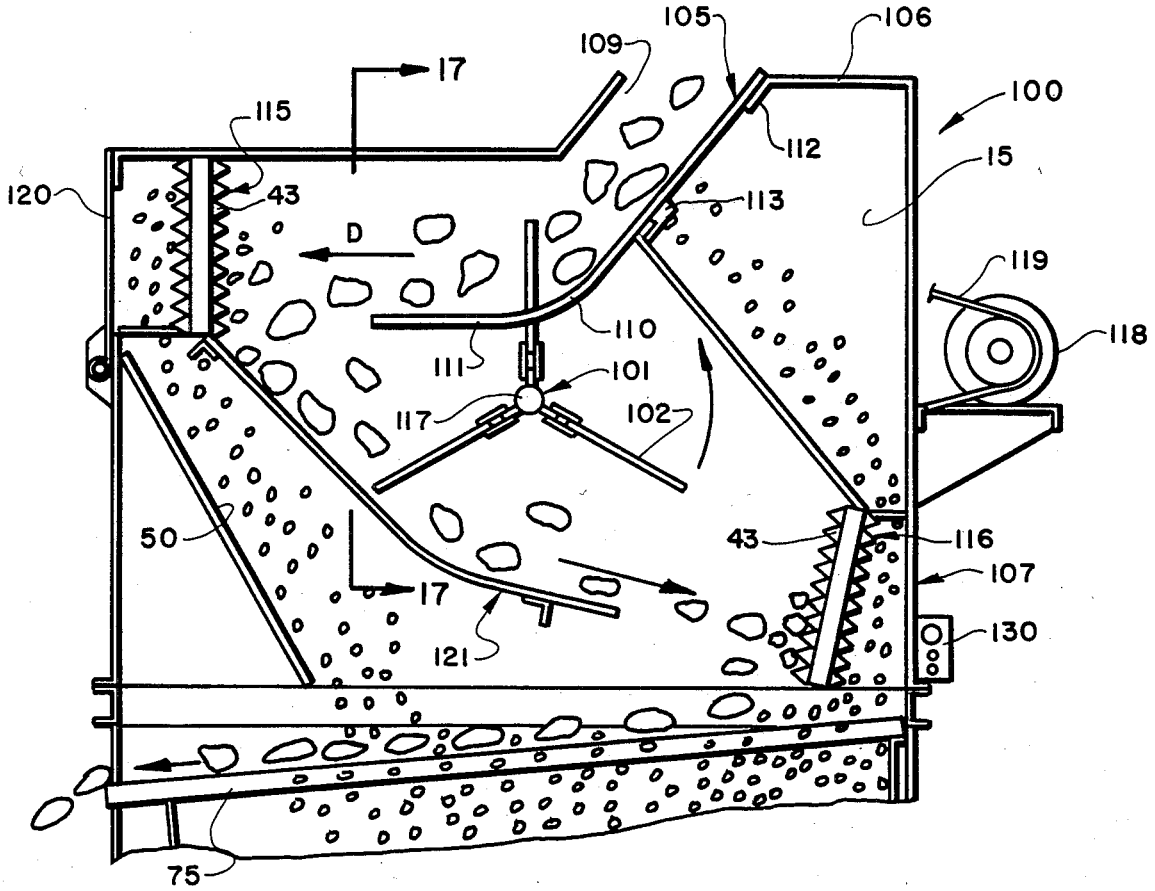
FIG. 16 is a side elevational view similar to FIG. 3 with the side wall of the hopper removed, showing a modified form of the invention in which a single double action rotor is mounted within the hopper replacing the double rotor arrangement of FIG. 3.
Figure 17:
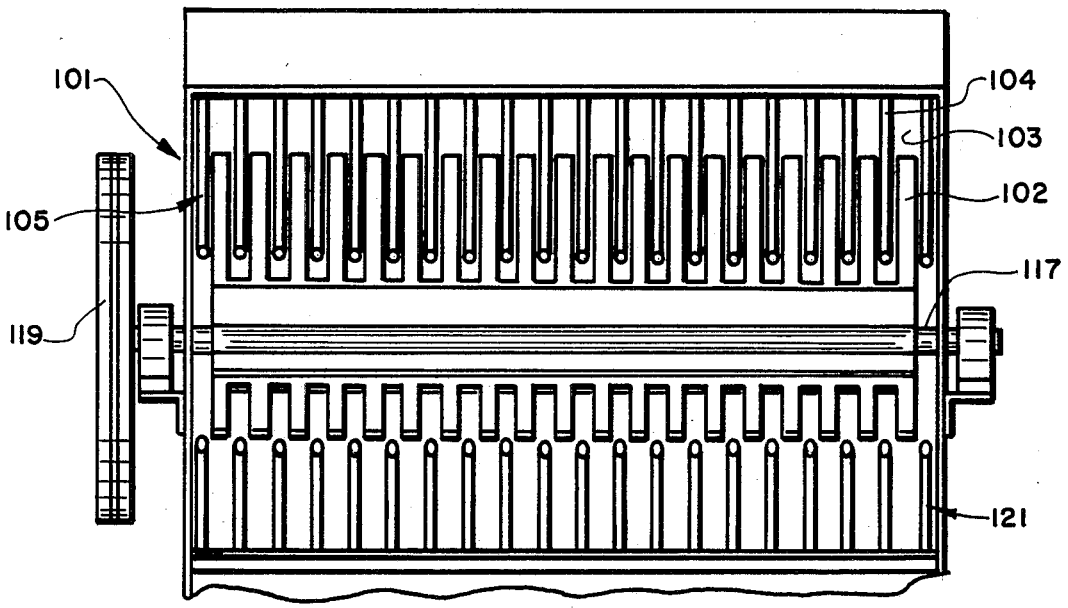
FIG. 17 is a fragmentary sectional view taken on line 17—17, FIG. 16.
Figure 18:
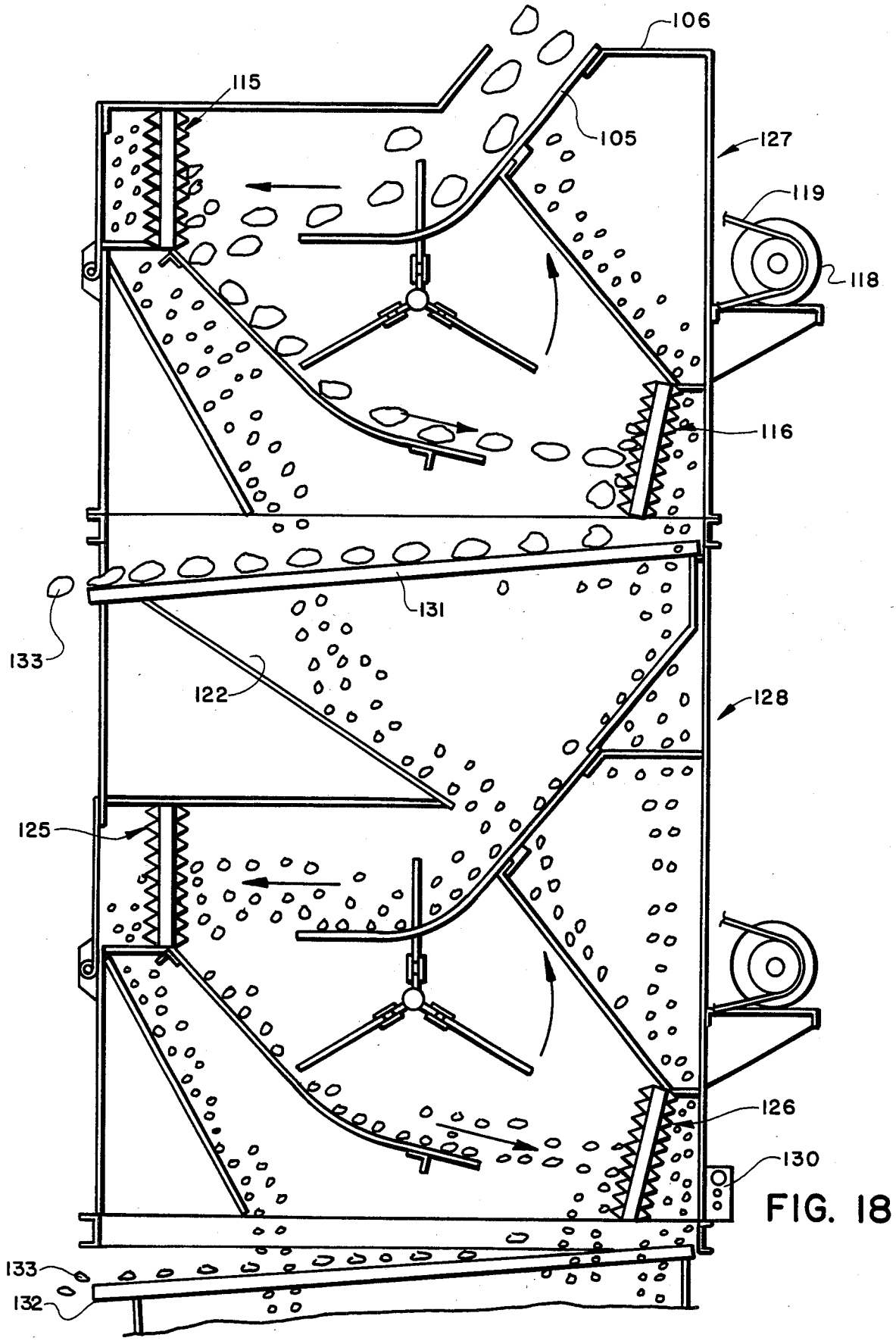
FIG. 18 is a fragmentary side elevational view similar to FIGS. 3 and 16 showing a pair of the single double action rotor units of FIG. 16 mounted in a stacked or cascaded relationship to each other.

A modified form of the invention is indicated generally at 100, and shown particularly in FIGS. 16–18. Modified breaker and sorter 100 is similar in most respects to breaker and sorter 1 described above except that it uses a single double action accelerator rotor indicated generally at 101, instead of the two accelerator rotors 27 and 60 of embodiment 1. Referring particularly to FIGS. 16 and 17, the single accelerator rotor 101 is a double action rotor. Rotor blades 102 which are similar to rotor blades 65, move through spaces 103 formed between parallel longitudinally extending inclined feed grate bars 104 (FIG. 17) which form inclined feed grate 105 which is similar to and provides a similar function as does feed grate 10. Grates 10 and 105 are also referred to as primary scalping grizzlies.

Feed grate 105 includes an upper straight portion 108 which extends downwardly inwardly from top wall 106 at coal inlet opening 109 and further includes a curved intermediate portion 110 which terminates in a generally horizontally extending portion 111. Grate 105 is mounted on and extends between the walls of hopper 107 by cross member 113 and an upper flange 112 of top wall 106. The spacings 103 between feed grate bars 104 are equal to the desired size of coal particles to be produced by breaker and sorter 100, which spacings also are equal to the size of openings formed in a pair of breaker or splitting grates 115 and 116. Rotor 101 is rotatably mounted on a shaft 117 driven by a single motor 118 and drive belt 119.

The coal and waste materials are dumped into hopper 107 through top wall opening 109 onto feed grate 105 with the already sized particles dropping through bar spaces 103 into chute 15 where they are subsequently deposited on vibrating grate 75. The larger coal particles and impurities move downwardly along grate 105 where they are accelerated along horizontal grate portion 111 by rotor blades 102. The accelerated coal is impacted against splitting grate 115 which is also referred to as a primary sizing or splitting grizzly, which is generally similar in construction to grates 40 and 70 of embodiment 1 described above. Grate 115 is mounted vertically or perpendicularly with respect to the direction of travel of coal being projected in the direction of arrow D, FIG. 16 by rotor blades 102. Grate 115 is located behind a pivotally mounted door 120 and is a double-sided grate. Pointed insert plates 43 are located on both sides of the grate bars enabling the grate to be removed from its mounting through open door 120 and then turned so that the second side becomes the impact or splitting surface. Also, it has been found that only one side of the point forming surfaces of pointed plates 43 become worn by the accelerated coal. The removably mounting and symmetrical arrangement of grates 115 and 116 enables four surfaces to be alternately used as the main impact surface by turning the plates upside down as well as reversing the front and rear teeth that are in the line of travel of the accelerated coal particles. Again, any coal particles of the desired size will pass through openings 44 of grate 115 where they are directed by chute 50 onto vibrating grate 75.

The oversized coal particles then move downwardly by gravity along the second inclined feed grate 121 which is similar to feed grate 53 where they are accelerated by rotor blades 102 of rotor 101 in the same manner as accomplished by rotor blades 65 of rotor 60 as shown in FIG. 3. These accelerated coal particles are impacted against the second splitting grate 116 which is similar to grate 70 of embodiment 1 except for the preferable mounting of pointed plates 43 on both sides of the grate. With this modified embodiment, only one rotor 101 is required for accelerating the coal as it follows a zigzag path through the hopper along the inlet grate 105 towards the first splitter grate 115 and also for accelerating the coal along the second inclined grate 121 toward the second splitting grate 116.

A still further modification of the improved coal sorter and breaker is shown in FIG. 18 in which a plurality of hopper units 127 and 128, each similar to hopper unit or embodiment 100 of FIG. 16, are stacked or cascaded by placing one unit on top of a second unit. With this arrangement the sized coal after passing through an intermediate vibrating grate 131 is directed by a chute 122 onto another slotted inclined feed grate 123 which is similar to upper feed grate 105, except that the spacings between the feed grate bars 124 are smaller than those of spaces 103 of feed grate bars 104. Likewise, a pair of splitting grates 125 and 126 are provided in lower unit 128 which are similar to splitting grates 115 and 116 of upper unit 127 except the openings thereof are smaller than those of grates 115 and 116.

Thus, upper unit 127 will fracture, break and collect coal having a particular particle size, for example two inches, with lower unit 128 having the bar spacings and splitting grate openings sized to pass coal particles of a smaller size, for an example one inch. The two inch size coal particles will pass through vibrating grate 75 and into lower unit 128 which further fractures and splits the coal particles to the one inch desired size which are ultimately discharged through another vibrating grate 132 into a collection area or conveyor. The refuse particles 133 will drop off grate 132 into a refuse collection area. Again, the operation and method of accomplishing this breakage and sizing is the same as that for unit 100 shown in FIG. 16.

It is also easily understood that the cascaded or stacked unit of FIG. 18 can be accomplished by stacking the double rotor unit configuration of FIG. 3 in which the upper and lower units each have two rotating rotors arranged as in embodiment 1. Also, three or more units can be cascaded to further reduce the coal size, if desired, without affecting the concept of the invention.

In accordance with one of the main features of the invention, the rotational speed of rotors 27 and 60 of embodiment 1 and rotor 101 of embodiment 100 are adjusted to match the particular hardness of the coal so that the coal particles upon impacting against the first grates 40 and 115 are mainly fractured instead of completely breaking or splitting into smaller particles. By maintaining the speed of acceleration of the coal as low as possible, it reduces the amount of energy required to rotate the rotors as well as reduces the friction and wear and tear on the rotors, splitting grates, etc. This low velocity of the accelerated coal also will eliminate the excessive breakage of the particles into fines which are undesirable. The fracturing will generally occur in the larger coal particles along lines formed therein by veins of sulphur or other impurities in the individual coal particles. This fractured coal then is accelerated either by second rotor 60 of embodiment 1 or the continued rotation of rotor 101 of embodiment 100. Since the coal is already fractured, this same low velocity will accelerate the coal sufficiently to break it into the desired small particles upon contacting splitting grates 70 and 116.

The operator merely fine-tunes the impact velocity of the rotors by adjustment of a potentiometer 130 which adjusts the speed of the accelerator rotor drive motors. The velocity is adjusted to match the individual coal seam being processed simply by turning a potentiometer dial. Since the impact velocity to fracture coal is less than that required to break refuse, the coal leaves the breaking cycle earlier and the rock, sulphur and tramp iron are isolated and removed from the lower end of the hopper. Furthermore, the adjustment of the rotor speeds enables the breaker and sorter to be finely adjusted for each individual seam of coal being processed since the hardness of the coal will vary between various seams. Another advantage is that the mounting of the various splitting grates adjacent hinged access doors enables the same to be replaced easily to eliminate downtime and also permits the grates to be turned upside down and rotated to provide a plurality of impact surfaces with a single grate and pointed structure. Also, the fine tuning of each rotor motor enables even the hardest coals to be broken, as well as softer coals, while requiring only a minimum amount of power for the breaking action. Thereby no excess horsepower and correspondingly no excess wasted energy is required for driving the rotors.

Improved coal breaker and sorters 1 and 100 include a number of other advantages not believed present in known coal breaker and sorter constructions. The removal of the sized coal particles as soon as possible in their trip through the zigzag hopper passageway by the openings in inclined feed grates 10 and 105, breakers 40 and 115, and inclined feed grates 53 and 121 eliminate the desired size particles from being further crushed and reduced into unusable size particles or fines. Most importantly is the propelling of the coal particles by the rotors in the same direction of travel as the particles were moving when struck by the rotor, enables the energy required to drive the rotors to be reduced considerably than with prior crusher constructions. This feature enables the rotors to be of less mass than heretofore required, since the rotors are not used for breaking the coal particles but only for propelling the same and increasing their speed. Also, splitting grates 40 and 70 and 115 and 116 are in line with the direction of travel of the accelerated particles and are slotted whereby the sized particles will pass through the grate openings, either directly or after being broken, for collection and removal by the associated delivery chutes.

This reduction in rotor size and weight enables the horsepower to be reduced considerably. As an example, coal breaker and sorter 1 having a capacity of processing three hundred and fifty tons of coal per hour requires twenty-two horsepower of energy. Drive motor 33 of first accelerator 27 is a 15 H.P. motor. Drive motor 61 of second accelerator motor 60 is a 5 H.P. motor, and motor 80 of vibrating grate 75 is a 2 H.P. motor. Prior crushing and sorting units of the same capacity require between fifty and one hundred horsepower of energy for processing the same amount of coal. This results in a considerable saving in energy cost as well as initial equipment expenditure.

Another advantage of improved breaker and sorters 1 and 100 is that rotor motors 33, 61 and 118 are variable speed motors and the speed thereof can be changed easily by a usual electrical motor control potentiometer 130 or a hydraulic motor with flow control which will regulate the speed of the rotors in relationship to that of the hardness of the coal being crushed and sorted by units 1 and 100. Thus, a hard seam of coal can be processed easily by merely increasing the speed of the accelerator rotor motors which increases the breakage of the coal upon its striking the splitting grates. Likewise, for a softer seam of coal the speed of the rotor motors would be decreased.

Improved coal sorter and breakers 1 and 100 are relatively compact and lightweight in contrast to existing breakers due to the smaller rotor size and motors. This enables the units to be transported easily into the strip mining pit and used on site to separate and size the coal immediately after being mined. This eliminates transporting the impurities along with the coal to a processing site after which the impurities are transported back to the pit or dump site. Also, if a source of electrical energy is not available at the pit or mine site, the electric motors can be replaced easily by hydraulic motors run by a portable compressor. Such hydraulic motors would be connected directly to the output of the rotor shafts eliminating the drive belts and associated sheaves. Likewise, units 1 and 100 can be modified easily for use in obtaining different size coal particles by merely replacing the inclined feed grates, splitting grates and vibrating grates with similar equipment with the desired size openings formed therein.

Accordingly, the improved coal breaker and sorter construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved coal breaker and sorter construction is constructed and used, the characteristics of the construction, and the advantageous, new and useful results obtained; the new and useful structures, devices, elements, arrangements, parts, and combinations, are set forth in the appended claims.

What is claimed is:

1. A coal breaker and sorter construction including:

(a) hopper having a passageway formed therein extending generally from an upper end to a lower end of the hopper, said hopper also being formed with an upper opening for depositing a supply of coal into the upper end of the passageway;

(b) first surface means located within the passageway for receiving the coal deposited through the upper opening and for directing the coal as it moves by gravity along the passageway;

(c) accelerator means mounted on the hopper and located within the passageway adjacent the first surface means for increasing the speed of the coal moving along the first surface means by striking the coal and propelling substantially all of said coal moving along said first surface means in the same direction as the slope of said first surface means;

(d) splitting means located in the passageway in the line of travel of the accelerated coal for splitting the coal upon impact when the coal strikes said splitting means; and (e) separator means mounted beneath the splitting means for separating particles of coal of a predetermined size from other particles contained in the supply of coal deposited in the hopper.

2. The construction defined in claim 1 in which the first surface means is a slotted grate having a plurality of predetermined sized openings formed therein, whereby coal particles of a predetermined size or smaller will pass through openings upon being deposited in the hopper preventing said predetermined size or smaller coal particles from being struck by the accelerator means.

3. The construction defined in claim 2 in which chute means is mounted beneath the slotted grate of the first surface means for receiving the predetermined size or smaller coal particles passing through the grate openings and for delivering said predetermined sized or smaller coal particles to a collection area.

4. The construction defined in claim 1 in which the splitting means includes a plurality of projections adapted to be struck by the accelerated coal for splitting said coal into smaller particles.

5. The construction defined in claim 4 in which the splitting means includes a grate having a plurality of predetermined sized openings formed therein whereby coal particles within a predetermined size range will pass through said openings after being struck by the accelerator means and broken by the projections of the splitting means.

6. The construction defined in claim 5 in which chute means is mounted beneath the splitting means for receiving the coal particles broken by the projections and passing through the grate openings and for delivering said sized particles to a collection area.

7. The construction defined in claim 1 in which the separating means includes a vibrating grate formed with a plurality of predetermined size openings.

8. The construction defined in claim 7 in which collection means is located beneath the vibrating grate for collecting coal particles passing through the openings of the vibrating grate.

9. The construction defined in claim 8 in which the collection means is a conveyor.

10. The construction defined in claim 1 in which the accelerator means includes a rotor having a shaft with a plurality of blades mounted thereon and extending radially outwardly from said shaft.

11. The construction defined in claim 10 in which the blades are resiliently mounted on the rotor shaft.

12. The construction defined in claim 10 in which the blades are formed with a plurality of spaced slots.

13. The construction defined in claim 1 in which the accelerator means is a pair of rotors spaced vertically with respect to each other in the passageway; in which each rotor includes a motor driven shaft and a plurality of radially extending blades; in which the first surface means extends generally tangent to the peripheral path defined by the blades of one of the rotors; in which a second inclined surface means is located adjacent to and beneath the splitting means for receiving coal after impacting against the splitting means; and in which the second inclined surface means extends generally tangent to the peripheral path defined by the blades of the other of the rotors.

14. The construction defined in claim 13 in which the first and second inclined surface means are grates formed with a plurality of predetermined sized openings.

15. A device for breaking coal into smaller particles and for removing coal particles of a predetermined size from remaining larger coal particles and other larger particles of impurities such as shale, sulphur balls, rock and the like that may be contained in a supply of coal; said device including:

(a) hopper means for receiving a supply of coal at an upper end thereof;

(b) passageway means formed within the hopper means for containing the supply of coal being broken and separated as it moves through said hopper means;

(c) inclined surface means located within the passageway means for controlling the direction of travel of the coal moving through the passageway means;

(d) rotor means having a plurality of outwardly extending blades mounted in the hopper means and communicating with the passageway means for striking the coal as it moves along the inclined surface means to increase the speed of the moving coal in the same direction of travel that the coal was following just prior to being struck by the rotor means, with the inclined surface means being generally tangent to a peripheral circular path defined by outer ends of the rotor means blades;

(e) impact surface means mounted in the passageway means in the line of travel of the accelerated coal for splitting the coal into smaller particles upon the coal striking the impact surface means; and (f) separation means for separting the predetermined sized coal particles from the larger coal particles after the coal has struck the impact surface means.

16. The device defined in claim 15 in which the rotor means includes a pair of vertically spaced power-driven rotors, each having a plurality of radially outwardly extending blades; in which the inclined surface means includes a pair of inclined surfaces located in the passageway means for directing the coal along a predetermined path in said passageway means; and in which each of the inclined surfaces are generally tangent to a respective peripheral circular path defined by the outer ends of the rotor blades.

17. The device defined in claim 16 in which the inclined surfaces are formed with a plurality of openings of a predetermined size for separating the smaller particles from the remaining coal; and in which means are located beneath each of the inclined surfaces for collecting the smaller coal particles passing through the surface openings.

18. The device defined in claim 16 in which the rotors are rotated in opposite directions with respect to each other; and in which the longitudinal axes of said rotors are parallel to each other.

19. The device defined in claim 16 in which the inclined surfaces each form an angle of approximately 35° with respect to a horizontal plane.

20. The device defined in claim 16 in which each of the rotors is driven by a variable speed motor.

21. A device for breaking coal into smaller particles and for removing coal particles of a predetermined size from remaining larger coal particles and other larger particles of impurities such as shale, sulphur balls, rock and the like that may be contained in a supply of coal; said device including:

(a) hopper means for receiving a supply of coal at an upper end thereof;

(b) zigzag-shaped passageway means formed within the hopper means providing at least first and second directions of travel for the coal and for containing the supply of coal being broken and separated as it moves through said hopper means;

(c) rotor means mounted in the hopper means and communicating with the passageway means for striking the coal to increase the speed of the moving coal as it moves along both the first and second directions of travel of the zigzag-shaped passageway means and for propelling substantially all of the struck coal along said directions of travel;

(d) first impact surface means mounted in line of the first direction of travel of the accelerated coal for fracturing the coal upon the coal striking the first impact surface means, and second impact surface means mounted in line of the second direction of travel of the accelerated coal for breaking the coal upon the coal striking the second impact surface means; and (e) separation means for separating the predetermined sized coal particles from the larger coal particles after the coal has struck the second impact surface means.

22. The device defined in claim 21 in which the rotor means includes a pair of vertically spaced power driven rotors, each having a plurality of radially outwardly extending blades; in which a pair of inclined surfaces are located in the passageway means for directing the coal along the zigzag-shaped passageway means; and in which each of the inclined surfaces are generally tangent to a respective peripheral circular path defined by the outer ends of the rotor blades for increasing the speed of the coal in the same direction of travel that the coal was following just prior to being struck by the rotor means.

23. The device defined in claim 21 in which the rotor means includes a power driven rotor having a plurality of radially outwardly extending blades; in which a pair of inclined surfaces are located in the passageway means for directing the coal in the first and second directions of travel along the zigzag-shaped passageway means; in which the first inclined surface means is formed with a plurality of slots; and in which the rotor blades pass through the slots of the first inclined surface means for striking the coal moving along said first inclined surface means.

24. The device defined in claim 23 in which the second inclined surface means is generally tangent to a peripheral circular path defined by the outer ends of the rotor blades.

25. The device defined in claim 21 in which the first and second impact surface means are each provided with opening means for removing the predetermined sized coal from the passageway means after contacting said impact surface means.

26. The device defined in claim 21 in which a plurality of units are placed in a stacked relationship with each individual unit including hopper means; zigzag-shaped passageway means, rotor means, first and second impact surface means, and separation means.

27. A device for breaking coal into smaller particles and for removing coal particles of a predetermined size from remaining larger coal particles and other larger particles of impurities such as shale, sulphur balls, rock and the like that may be contained in a supply of coal; said device including:

(a) hopper means for receiving a supply of coal at an upper end thereof;

(b) zigzag-shaped passageway means formed within the hopper means providing at least first and second directions of travel for the coal and for containing the supply of coal being broken and separated as it moves through said hopper means;

(c) a pair of inclined surfaces located in the passageway means for directing the coal along the zigzag-shaped passageway means;

(d) rotor means mounted in the hopper means and communicating with the passageway means for striking the coal to increase the speed of the moving coal as it moves along the inclined surfaces of the zigzag-shaped passageway means, said rotor means including a pair of vertically spaced power driven rotors, each having a plurality of radially outwardly extending blades, and with the inclined surfaces being generally tangent to a respective peripheral circular path defined by outer ends of the rotor blades for increasing the speed of the coal in the same direction of travel that the coal was following just prior to being struck by the rotor means;

(e) first impact surface means mounted in line of the first direction of travel of the accelerated coal for fracturing the coal upon the coal striking the first impact surface means, and second impact surface means mounted in line of the second direction of travel of the accelerated coal for breaking the coal upon the coal striking the second impact surface means; and (f) separation means for separating the predetermined sized coal particles from the larger coal particles after the coal has struck the second impact surface means.

28. A device for breaking coal into smaller particles and for removing coal particles of a predetermined size from remaining larger coal particles and other larger particles of impurities such as shale, sulphur balls, rock and the like that may be contained in a supply of coal; said device including:

(a) hopper means for receiving a supply of coal at an upper end thereof;

(b) zigzag-shaped passageway means formed within the hopper means providing at least first and second directions of travel for the coal and for containing the supply of coal being broken and separated as it moves through said hopper means;

(c) rotor means mounted in the hopper means and communicating with the passageway means for striking the coal to increase the speed of the moving coal as it moves along both the first and second directions of travel of the zigzag-shaped passageway means, said rotor means including a power driven rotor having a plurality of radially outwardly extending blades;

(d) first and second inclined surface means located in the passageway means for directing the coal in the first and second directions of travel along the zigzag-shaped passageway means, said first inclined surface means being formed with a plurality of slots for passage of the rotor blades therethrough for striking the coal moving along said first inclined surface means;

(e) first impact surface means mounted in line of the first direction of travel of the accelerated coal for fracturing the coal upon the coal striking the first inclined surface means, and second impact surface means mounted in line of the second direction of travel of the accelerated coal for breaking the coal upon the coal striking the second impact surface means; and (f) separation means for separating the predetermined sized coal particles from the larger coal particles after the coal has struck the second impact surface means.

29. The device defined in claim 28 in which the second inclined surface means is generally tangent to a peripheral circular path defined by outer ends of the rotor blades.

30. A device for breaking and sorting a quantity of material into predetermined size particles including:

(a) hopper means for receiving a supply of material at an upper end thereof;

(b) zigzag-shaped passageway means formed within the hopper means providing at least first and second directions of travel for the material and for containing the supply of material being broken and separated as it moves through said hopper means;

(c) a pair of inclined surfaces located in the passageway means for directing the material along the zigzag-shaped passageway means;

(d) rotor means mounted in the hopper means and communicating with the passageway means for striking the material to increase the speed of the material as it moves along the inclined surfaces of the zigzag-shaped passageway means, said rotor means including a pair of power driven rotors, each having a plurality of radially outwardly extending blades, and with the inclined surfaces being generally tangent to a respective peripheral circular path defined by outer ends of the rotor blades for increasing the speed of the material in the same direction of travel that the material was following just prior to being struck by the rotor means;

(e) first impact surface means mounted in line of the first direction of travel of the accelerated material for breaking a portion of the material upon the material striking the first impact surface means, and second impact surface means mounted in line of the second direction of travel of the accelerated material for breaking another portion of the material upon the material striking the second impact surface means; and (f) separation means for separating the predetermined sized particles of materials from the larger material particles after the material has struck the second impact surface means.

* * * * *